US005580154A

United States Patent [19]

Coulter et al.

[11] Patent Number: 5,580,154

[45] Date of Patent: Dec. 3, 1996

[54] GLOW-IN-THE-DARK GLOVE APPARATUS

[76] Inventors: James D. Coulter; Jovee Coulter, both c/o Lu Albello 131 Wallace St., Bartlett, Ill. 60103

[21] Appl. No.: 294,988

[22] Filed: Aug. 24, 1994

[51] Int. Cl.[6] ..... F21L 15/08

[52] U.S. Cl. ..... 362/103; 362/84; 63/1.1; 446/485; 2/160

[58] Field of Search ..... 362/103, 104, 362/84; 63/1.1, 2, 15; 446/26, 485, 219; 2/243.1, 160, 167, 169; 340/573

[56] References Cited

U.S. PATENT DOCUMENTS

| | | | |
|---|---|---|---|
| 1,046,225 | 12/1912 | Schindler | 362/103 |
| 1,230,943 | 6/1917 | Sundh | 362/103 |
| 1,496,484 | 6/1924 | Monaco | 362/103 |
| 1,513,237 | 10/1924 | Green | 63/1.1 |
| 3,638,011 | 1/1972 | Bain et al. | 240/6.4 |
| 3,649,029 | 3/1972 | Worrell | 362/245 |
| 3,804,307 | 4/1974 | Johnston | 63/1.1 |
| 4,625,339 | 12/1986 | Peters | 2/160 |
| 4,766,611 | 8/1988 | Kim | 2/160 |
| 5,027,439 | 7/1991 | Spector | 2/161 |
| 5,177,467 | 1/1993 | Chung-Piao | 340/574 |
| 5,357,636 | 10/1994 | Dresdner, Jr. et al. | 2/167 |

*Primary Examiner*—Y. Quach
*Attorney, Agent, or Firm*—Victor Flores

[57] ABSTRACT

A glove apparatus including a glove member having an outer surface covering material, such as a pliable plastic, treated with an illuminative substance having phosphorescence, fluorescent, or both, illuminative properties. The glove apparatus includes a light circuit system integrally packaged with the glove member. The light may be selectively energized and may be directionally controlled by the user of the apparatus to illuminate an object. The light is contained within a ring-like light housing member which is preferably mounted on a finger section of the glove member. As a child glove toy item, the outer glove surface covering material is decorated to ornately represent a fictional cartoon hero character. Variations of the apparatus include a light filter adapted with a screen shaped in the form of the cartoon character to effect projecting an image of the cartoon character upon a child energizing the light circuit system. Other variations include audio and video circuits electrically coupled to enhance and promote utilization of the apparatus.

15 Claims, 2 Drawing Sheets

GLOW-IN-THE-DARK GLOVE APPARATUS

FILED OF THE INVENTION

This invention relates to gloves. More particularly, the present invention relates to gloves and the materials used for fabricating the glove and glove accessories that enhance glove utilization. Even more particularly, the present invention relates to glove structures designed using illuminative technology in combination with glove accessories, such as lighting and audio accessories that appeal to youth.

DESCRIPTION OF THE PRIOR ART

The glove has benefitted mankind in countless ways, including working and sporting applications. Glove structures which have included accessory structures, other than the structural material covering the user's hands are similarly numerous. Accessory structures include watch devices such as taught by U.S. Pat. No. 4,766,611, light accessories as taught by U.S. Pat. Nos. 3,638,011 and 4,625,339. While the modified glove structures have taught useful accessories, in particular glove structures with light accessories, the modified glove structures have not found commercial success with the youth consumer group.

A missing ingredient in modified glove structures is structure that generates appeal while providing the useful accessory. For example, to applicants' knowledge, illuminative technology, such as fluorescence and phosphorescence technology, has not been utilized in fabricating the material that comprises the glove covering structure. Further, the accessories found in modified glove structures have not included structure which enhance appeal to youth, especially in providing an additional sense of security if the accessory happens to be a night light.

Youth relate to fictional cartoon heros as observed on television, or from reading about them in a comic book. Nighttime security and comfort for youth is often found in an object used in play acting and which represents the powerful cartoon hero. Further security and comfort for youth is certainly found in a night light, which sometimes is a flashlight tucked beneath the blankets. Powerful cartoon heroes are typically garbed with gloves and other highly decorative symbols that appeal to youth.

To applicants' knowledge, modified glove structures having useful accessories have not included glove covering material that glows in the dark. This deficiency exists eventhough technology exists for providing covering material that glows, either momentarily, as made possible if using a covering material treated with a fluorescent substance, or for longer durations, as made possible if using a covering material treated with phosphorescent substance. Further, to applicants' knowledge, modified glove structures have not included glow-in-the-dark material in combination with light accessories. Still further, to applicants' knowledge, modified glove structures have not included glow-in-the-dark material in combination with light accessories that include structure that communicate an association with a powerful fictional cartoon character useful for appealing to youth consumer groups. Therefore, a need is seen to exist for a modified glove structure that embodies the foregoing deficiencies.

SUMMARY OF THE INVENTION

Accordingly, the primary object of the present invention is to provide a modified glove structure having useful accessories and which particularly includes glove covering material that glows in the dark, such as a covering material treated with a fluorescent substance, or more generally with a phosphorescent substance.

Another object of the present invention is to provide a modified glove structure having covering adapted with glow-in-the-dark material, as noted above, in combination with accessories, such as lighting, audio and video accessories.

Yet another object of the present invention is to provide a modified glove structure as described above modified in particular to communicate to a youth user an association with a powerful fictional cartoon character.

The foregoing objects are accomplished by providing modified glove structure including a glove member having an outer surface covering material treated with at least one illuminative substance, such as a covering material treated with a fluorescent substance, or more generally with a phosphorescent substance, and further having an accessory item, such as a lighting, audio, or video accessory item, integrally packaged with the glove member. The modified glove structure may optionally include structural features which enhance utilization, which features would communicate to a youth user an association with a powerful fictional cartoon character.

Therefore, to the accomplishments of the foregoing objects, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

DESCRIPTION OF THE PREFERRED EMBODIMENT

Figure 1:
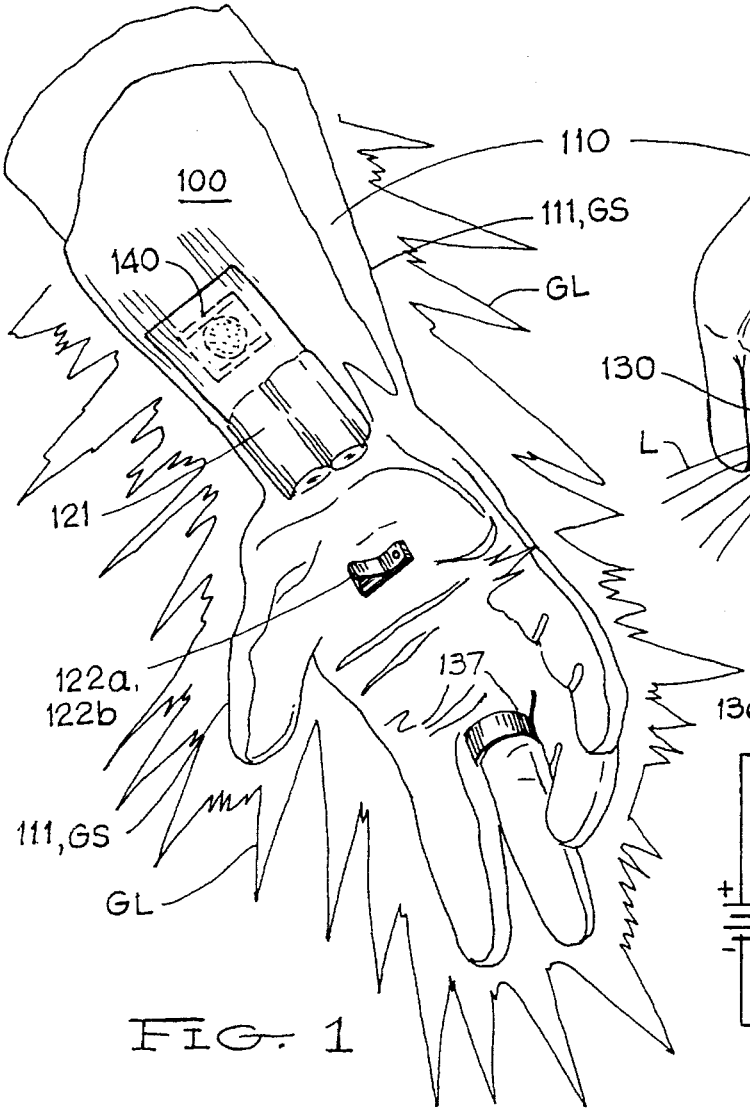
FIG. 1 is a perspective view of an illuminative glove apparatus in accordance with the present invention illustrating an underside of the illuminative glove member adapted with electrical components of a light and audio circuit accessory conveniently mounted for ease of finger operation and carriage.
Figure 4:
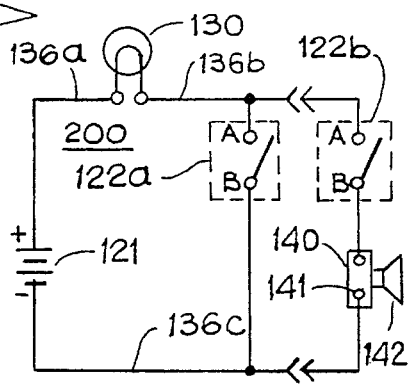
FIG. 4 is an electrical diagram of the light and audio circuit which is packaged on the wall structure of the illuminative glove member.
Figure 5:
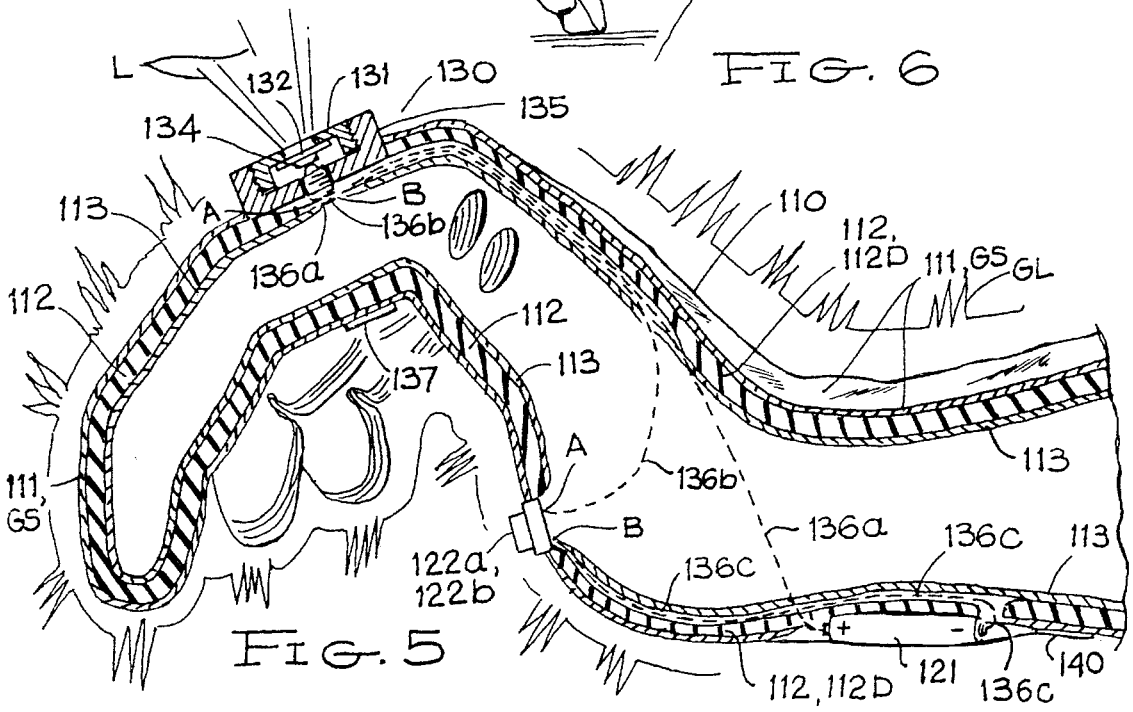
FIG. 5 is a cross-sectional view of the illuminative glove apparatus illustrating a layering and packaging arrangement of the glove structure and light system including the inner lining, the circuit wiring and housing, the rubber foam insulative padding and the outer glove covering material treated with an illuminative substance.

Referring first to FIG. 1 where an illuminative glove apparatus 100 is illustrated in accordance with the present invention. Glove apparatus 100 is shown comprising a glove member 110 integrated with a light and audio system 200, see generally FIG. 4. As depicted in FIGS. 1 and 5, the outer glove surface material 111 is treated with an illuminative substance GS for producing a glow GL.

The light and audio system 200 may be provided with the light circuit portion 130, the audio circuit portion 140, or both. Although not electrically diagramed, technology is presently available for also integrating a miniature television accessory 150 with the glove member structure, see generally FIG. 2. The battery component 121 is preferably mounted on the wrist portion of the glove, while the ON/OFF switch 122*a* (122*b*) preferably mounted on the heel of the gloves's palm portion to facilitate being operated by finger clinching action. Switch 122*a* being utilized if only light circuit 130 is provided and switch 122*b* being utilized if both light circuit 130 and audio circuit 140 is provided. Wiring 136*c* closes the circuit from switch 122*a* (122*b*) to the battery component 181. Audio circuit includes audio source 141, such as a radio or cassette player, and speaker 142.

Figure 2:
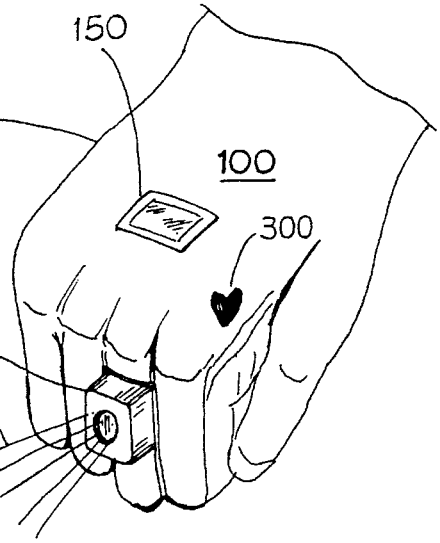
FIG. 2 is a fist-side perspective view of the illuminative glove apparatus illustrated in FIG. 1 further illustrating the light housing member mounted below the glove's knuckle portion for being directionally controlled by a user's wrist and finger movement.
Figure 3:
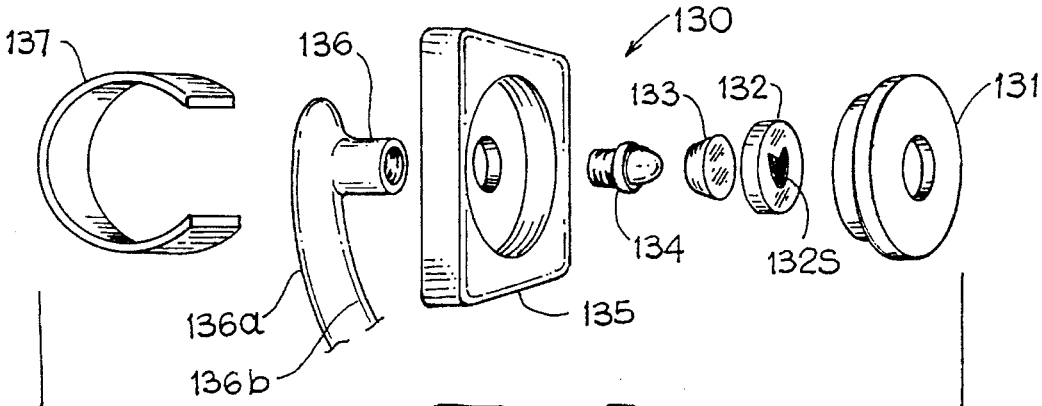
FIG. 3 is a perspective view of the light housing member illustrating an assembly arrangement of the various parts employed.

As best seen in FIG. 3, the light circuit portion 130 is preferably packaged in a housing and comprises an arrangement of electrical and mechanical components including an open-ended ring retainer member 137, electrical wiring and socket assembly 136, 136*a*, 136*b*, a base plate 135, a light bulb 134, a reflective member 133, a lens light filter member 132, an optional lens screen member 132S, and a lens cap member 131. Base plate 135 is preferably treated with an illuminative substance that contrasts in glow color with the illuminative substance treatment provided on glove surface 111. Lens member 132 and screen 132S provide the means for projecting, by example, an image of a powerful cartoon character upon energizing of light 130. As best seen in FIG. 2, light housing member assembly 130 is preferably mounted below the glove's knuckle portion for providing better control of directing light L by a user's wrist and finger movement.

FIG. 5 illustrates, in cross-section, a view of the glove apparatus 100 illustrating, by example, the layering and packaging arrangement of the glove structure and the light and audio circuit accessories. Basically, as illustrated, glove member 110 includes an inner lining 113, insulative material 112 with wire routing depressions 112D and an outer surface material 111 suitably treated with an illuminative substance GS for producing a glow GL. Light assembly 130 components (retainer 137, wiring 136*a* and 136*b*, base plate 135, light bulb 134 and reflective member 133, and lens 132 and lens cap 131) are shown mounted on a finger portion of glove member 110, while battery 121 and audio circuit 140 components are shown wrist mounted and being operable by palm mounted switch 122*a* (122*b*). The technology associated with the illuminative chemical treatment of outer surface material 111, such as a glowing pliable plastic material, is believed to be presently commercially available and is not within the scope of the present invention. The specifications for glove material 111 would include a phosphorescence requirement (a glow requirement) of a desired glow color and the desired duration of glow, ie. a requirement for a treatment with at least one illuminative substance GS to yield a fluorescent (short duration) or phosphorescent (longer duration) glow effect. To achieve the desired glow effect, the glove material may be treated with a combination of substances having fluorescent and phosphorescence illuminative properties.

Figure 6:
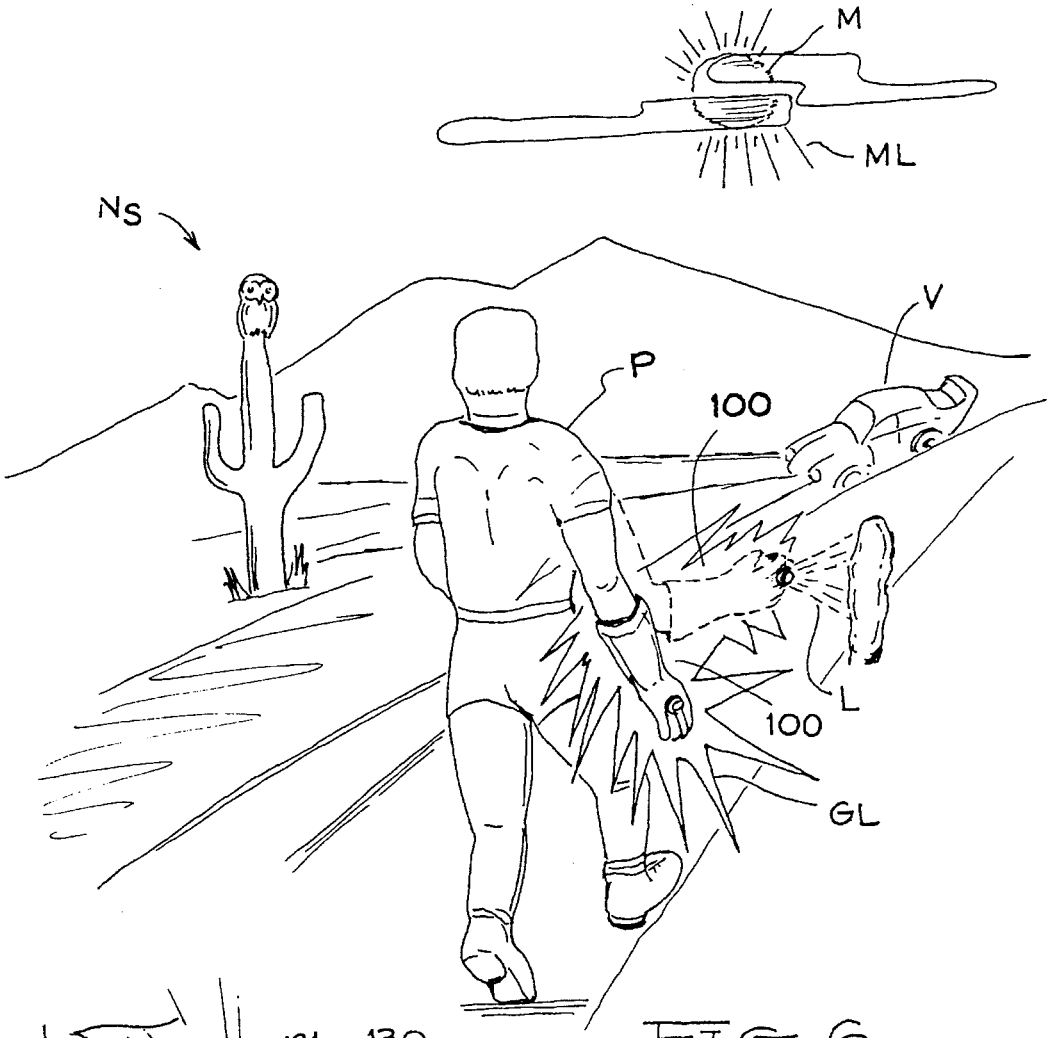
FIG. 6 is a night scene illustrating a user wearing the glove apparatus of the present invention illustrating the glow-in-the-dark feature and utilization of the user-controlled lighting system.

FIG. 6 shoes a night scene NS illustrating a user pedestrian P wearing glove apparatus 100 as a personal safety item where glove apparatus 100 provides a reflective glow from moon and moonlight M, ML and light from an oncoming vehicle V, and further illustrating the utilization of the light circuit to illuminate objects along the path that may impede travel.

Other application may include use of glove apparatus 100 as a comfort security item by a child at night, where glove apparatus 100 is decorated with decoration 300 as shown in FIG. 2 representing the child's favorite cartoon hero. Light system may be modified to produce a safelevel laser light for use in laser tag games.

Therefore, while the present invention has been shown and described herein in what is believed to be the most practical and preferred embodiments, it is recognized that departures can be made therefore within the scope of the invention, which scope is therefore not to be limited to the details disclosed herein, but is to be accorded the full scope of the claims so as to embrace any and all equivalent apparatus.

We claim:

1. A glove apparatus, said apparatus comprising:

a glove member, said glove member having an outer surface covering material treated with at least one illuminative substance; and an accessory item integrally assembled and being a structural part of said glove member, said accessory item being a light circuit system for being energized and directionally controlled by a user of said apparatus, said light circuit system comprising at least one light and light housing member mounted about a finger section of said glove member utilizing a ring retainer member.

2. A glove apparatus as described in claim 1, wherein:

said outer surface covering material being treated with said substance having phosphorescence illuminative properties.

3. A glove apparatus as described in claim 1, wherein:

said outer surface covering material being treated with said substance having fluorescent illuminative properties.

4. A glove apparatus as described in claim 1, wherein:

said outer surface covering material being formed substantially on a non-palm portion of said glove member.

5. A glove apparatus as described in claim 4, wherein:

said outer surface covering material being treated with said substance having phosphorescence illuminative properties.

6. A glove apparatus as described in claim 4, wherein:

said outer surface covering material being treated with said substance having fluorescent illuminative properties.

7. A glove apparatus as described in claim 1, wherein:

said light circuit system further comprises a switch member mounted on a palm section of said glove member.

8. A glove apparatus as described in claim 1, wherein:

said light housing member comprising a base plate member formed from a material having illuminative properties that contrasts in glow color with said substance used to treat said outer surface covering material.

9. A glove apparatus as described in claim 1, wherein:

said light housing member further comprises at least one light filter constructed having light filtering properties for producing colored lighting, said at least one filter being adapted with a screen to effect projecting an image of said screen upon energizing said at least one light.

10. A glove apparatus as described in claim 1, wherein:

said outer surface covering material being decorated to ornately represent a fictional cartoon character, and said light housing member further comprises at least one light filter adapted with a screen shaped in the form of said cartoon character to effect projecting an image of said fictional cartoon character upon energizing said at least one light.

11. A glove apparatus, said apparatus comprising:

a glove member, said glove member having an outer surface covering material having illuminative properties; and a light circuit system integrally assembled and being a structural part of said glove member for being energized and directionally controlled by a user of said apparatus, said light circuit system comprising at least one light and light housing member mounted about a finger section of said glove member utilizing a ring retainer member, said light housing member comprising a base plate member formed from a material having illuminative properties that contrasts in glow color with said illuminative properties of said outer surface covering material.

12. A glove apparatus as described in claim 11, wherein:

said outer surface covering material being decorated to ornately represent a fictional cartoon character, and said light housing member further comprises at least one light filter adapted with a screen shaped in the same form as said cartoon character to effect projecting an image of said fictional cartoon character upon energizing said at least one light.

13. A glove apparatus, said apparatus comprising:

a glove member, said glove member having an outer surface covering material treated with at least one illuminative substance;

a light circuit system integrally assembled and being a structural part of said glove member for being energized and directionally controlled by a user of said apparatus, said light circuit system comprising at least one light and light housing member mounted about a finger section of said glove member utilizing a ring retainer member, said light housing member comprising a base plate member formed from a material having illuminative properties that contrasts surface covering material; and an audio circuit electrically coupled to said light circuit system.

14. A glove apparatus as described in claim 13, wherein:

said outer surface covering material being treated with said substance having phosphorescence illuminative properties;

said audio circuit being operative to synchronously energized with said at least one light, and said apparatus further comprising a miniature television accessory electrically coupled to said light circuit system.

15. A glove apparatus as described in claim 13, wherein:

said outer surface covering material being decorated to ornately represent a fictional cartoon character, said light housing member further comprises at least one light filter adapted with a screen shaped in the same form as said cartoon character to effect projecting an image of said fictional cartoon character upon energizing said at least one light.

* * * * *